United States Patent [19]

Villoch et al.

[11] Patent Number: 4,799,527

[45] Date of Patent: Jan. 24, 1989

[54] VERTICAL BLIND ASSEMBLY

[75] Inventors: Joe D. Villoch, North Miami; Claudio U. Gatto, Miami; Mike V. Oprisi, Miami Lakes, all of Fla.

[73] Assignee: American Vertical Systems, Miami, Fla.

[21] Appl. No.: 49,653

[22] Filed: Apr. 30, 1987

[51] Int. Cl.[4] ..... E06B 9/30

[52] U.S. Cl. ..... 160/168.1; 160/900

[58] Field of Search ..... 160/168 R, 166 A, 166 R

[56] References Cited

U.S. PATENT DOCUMENTS

| | | | |
|---|---|---|---|
| 3,996,988 | 12/1976 | de Witt | 160/168 R |
| 4,262,728 | 4/1981 | Debs | 160/168 R |
| 4,628,981 | 12/1986 | Ciriaci et al. | 160/168 R X |
| 4,648,436 | 3/1987 | Oskam | 160/168 R |
| 4,657,060 | 4/1987 | Kaucic | 160/168 R |

*Primary Examiner*—Ramon S. Britts
*Assistant Examiner*—Blair Johnson
*Attorney, Agent, or Firm*—John Cyril Malloy

[57] ABSTRACT

A vertical blind assembly of the type comprising a plurality of vertically oriented slats or blinds depending from a supporting header structure movable both along the length thereof, as well as each being rotatable about their individual longitudinal axis. A carrier assembly is structured to accomplish rotation of a carrier element removably supporting each of the slats by rotation of a drive rod through the structural design and relative disposition of intermeshing gears, a first of which is interconnected to rotate with the drive rod and a second of which is interconnected to rotate with the carrier element.

19 Claims, 4 Drawing Sheets

VERTICAL BLIND ASSEMBLY

BACKGROUND OF THE INVENTION

1. Field of the Invention

This invention relates to a vertical blind assembly wherein each of a plurality of vertically oriented blinds or slats are supported both for movement along the length of a supporting header structure and rotation along their own longitudinal axis through the structural design and workings of a carrier assembly incorporating specifically disposed and configured intermeshing gear elements which accomplish rotation of the individual slats through a predetermined arc of travel.

2. Description of the Prior Art

Vertical blind assemblies or structures of the type incorporating a plurality of vertically oriented and depending blinds capable of traversing the length of a track mounted on a suspended header structure are well known in the prior art and commercially available to the public in various forms and designs. Typically, such assembly provides for the traversing movement of the plurality of depending blinds in the aforementioned fashion and also allows the angular rotation or tilting of the blinds collectively into a common angular orientation about the respective longitudinal axis of the blinds. This angular orientation controls or regulates the amount of light or viewing through the individual blinds. Vertical blind assemblies of the type set forth above generally include a carrier element removably secured to an upper end thereof. Each carrier element is pivotally or rotatably mounted on a carrier assembly. Individual carrier assemblies are extendable collectively along the length of the header casing or alternately retracted into a closely adjacent position. Such positioning depends on whether it is preferred to extend the vertical blinds along the entire length through the head casing or collect the blinds at one end thereof so as to allow complete passage or access through the opening which the vertical blind assembly is intended to overhang and possibly cover. The positioning structure or assembly is associated in driving interconnection with each of the carrier structures supporting the individual holders and attached blinds wherein such positioning means is structured to provide the aforementioned travel and/or angular pivotal movement of the blinds.

Numerous prior art structures are known which are specifically directed to the prior art of vertical blind assemblies. Structures of the type referred to are the subject of U.S. Pat. Nos. 4,262,728; 4,122,884; 4,616,688; 4,267,875; 4,293,021; and 2,754,902. While the structures disclosed in such patents are considered to be operable for their intended and designed purpose, frequently, numerous prior art structures are considered to be rather complex and therefor add to the initial expense of the vertical blind assembly or the cost of maintenance and/or repair of such structures.

While complexity is a factor in considering the structural components and operative features of blind assemblies of this type, it should also be kept in mind that various structural components utilized in such assemblies are frequently required to be replaced and/or repaired in order to keep the assembly in proper working order. Therefore, there is still a recognized need in the prior art relating to blind assemblies for the vertical blind structure specifically designed to be long-lasting and durable and incorporate a design configuration which allows easy replacement and/or repair of the various components of such a structure without total disassembly.

SUMMARY OF THE INVENTION

The present invention relates to an improvement in a carrier assembly of the type associated with each of a plurality of vertically oriented blinds or slats of a vertical blind assembly. In the present invention, the plurality of carrier assemblies are of course equal in number to the number of slats being supported. The carrier assemblies further are cooperatively interconnected or associated with a cable assembly which allows for the selective and collective positioning of the blind along the length of a supporting header structure either in an extended or retracted position, respectively defined by the blinds disposed in spaced apart relation to one another as they extend along at least a portion of the length of the header structure or alternately, wherein such blinds are bunched together at one or both ends of the header structure.

Further, the carrier assembly is specifically structured to accomplish rotation of the blinds along their own longitudinal axis wherein all the blinds are oriented at the same angle to accomplish uniformity in appearance and an effective control of the amount of light passing through the spaced apart blinds. Such collective and effectively synchronized rotation and angular orientation of the plurality of blinds is accomplished first through rotation of a drive rod, which in turn may be rotated in opposite directions through manipulation of a pull chain or the like. The drive rod has an elongated configuration equal in length substantially to the header structure and passing into cooperative interconnection with each of the carrier assemblies. Rotational support of the elongated drive rod to the header assembly, and the controlled rotation thereof, is accomplished through the provision of a drive means.

The drive means of the present invention includes two end caps each secured to an opposite end of the header assembly and each attached to a respectively positioned opposite extremity of the drive rod. One of the end caps is structured for cooperative interconnection with the aforementioned cable assembly wherein manipulation of the cable assembly causes rotation of roller or pulley components of the one end cap and rotation of the drive rod itself. The opposite end cap is of course secured to the opposite end of the drive rod and supportedly mounted on the opposite end of the header assembly. This opposite or second end cap has a supporting member engaging the end of the drive rod and rotatable therewith upon its forced rotation by manipulation of the cable assembly as set forth above. This second end cap also has a roller element to supportingly engage a length of the cable or cord extending along the interior length of the header assembly and cooperatively positioned relative to the individual carrier assemblies.

Each of the carrier assemblies includes a drive element connected to the drive rods so as to rotate therewith along the longitudinal central axis of the drive rod. The drive element includes a specifically configured and dimensioned first gear extending outwardly from the drive element and disposed in intermeshing engagement with a second gear. The second gear is connected to the carrier element which is located substantially transversely to the drive rod and drive element and depends from each of the carrier assemblies in supporting and removable engagement with an upper end of a vertically supported blind or slat.

One feature of the present invention is the curvilinear configuration of the first gear, which defines a curvilinear segment gear of specific length and its cooperative relation with a stop element mounted on the base of the carrier assembly in interruptive position relative to the path along which the curvilinear segment gear rotates upon the selective rotation of the drive rod. The curved segment gear is so positioned as to cause abutting engagement of opposite ends thereof with a stop element when the segment gear and the drive rod are rotated respectively in opposite directions. The abutting engagement of the stop element which with each of the opposite ends of the segment gear thereby restricts the displacement or degree of rotation of the segment gear and accordingly, the amount of rotation of the carrier element and the depending supported vertical slat or blind attached thereto. It should be readily apparent that each of the segment gears has a common dimension and configuration and are equivalently oriented relative to the second gear. Each of the slats are concurrently rotatable at the same angular orientation to accomplish uniformity in appearance and effective controlling of light passing through the blinds.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
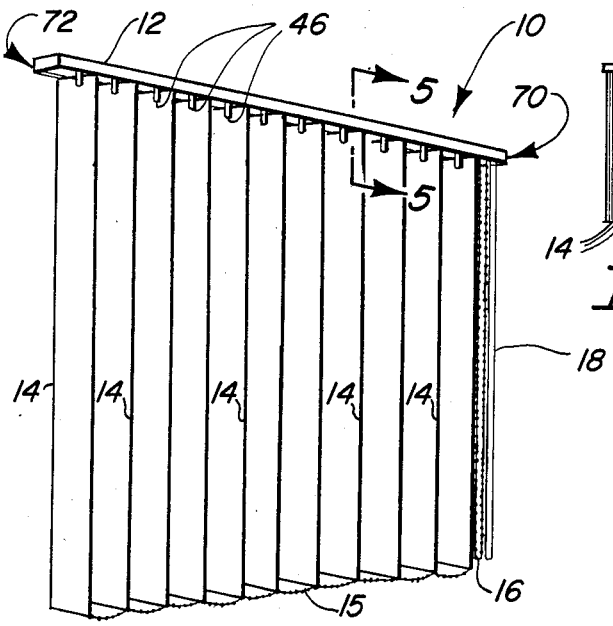
FIG. 1 is an isometric view of a vertical blind assembly of the present invention.
Figure 2:
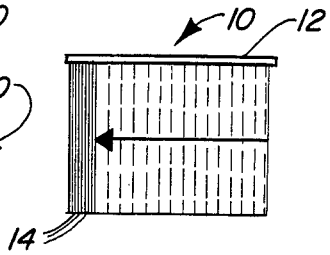
FIGS. 2, 3 and 4 are each independent schematic views showing different orientations of the subject vertical blind assembly, wherein an expanded orientation is represented in phantom lines and a contracted orientation of the blinds are representative in solid line, and further wherein the arrows represent direction of travel of the blinds between the expanded and contracted positions.
Figure 3:
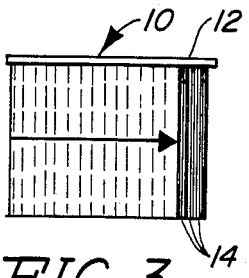
Figure 4:
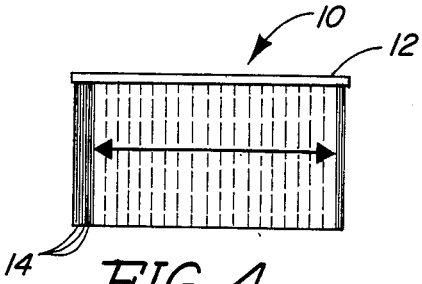
Figure 6:
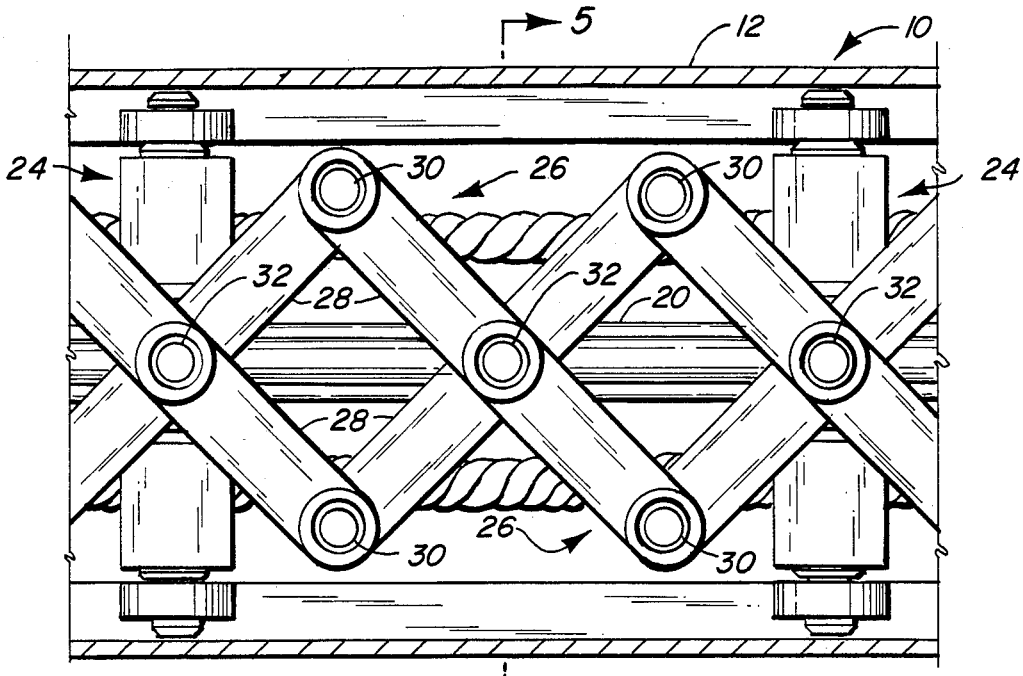
FIG. 6 is a sectional view in partial cut-away along line 6—6 of FIG. 5.

As shown in FIGS. 1 through 4, the present invention is directed towards a vertical blind assembly, generally indicated as 10, of the type including a supporting header structure 12 from which a plurality of vertically oriented blinds or slats 14 are supported in depending relation therefrom. Conventional pulling and cable assemblies including a beaded pull chain 16 and a pull cord 18 may be interconnected adjacent one end of the header structure 12 to what may be referred to as a drive assembly disclosed in detail in FIGS. 8 through 27. One of the structures, such as beaded pull chain 16, serves to rotate an elongated drive rod 20 through interconnection with a drive pulley which is part of the drive assembly and which will be explained in greater detail hereinafter. Pull cord 18 serves to cause movement of an elongated drive cord 22 (and may be a part thereof) which extends along the length of the header structure 12 in cooperative association with each of a plurality of carrier assemblies generally indicated as 24. Further, each of the carrier assemblies 24 are interconnected to one another by a connecting means generally indicated as 26, comprising a plurality of connecting links 28, each pivotally attached to one another at various points 30, as best shown in FIG. 6. In addition, the individual links 28 are pivotally attached to a pin member 32, substantially at the middle point of the links 28 so as to support each of the carrier assemblies 24 thereon (see FIG. 7). It should be obvious that the connecting means 26, including the plurality of interconnecting links 28, is therefore capable of movement between the expanded and contracted positions as schematically represented in FIGS. 2, 3 and 4 so as to equally vary the distance between the carrier assemblies 24, and accordingly, between the depending slats 14.

Figure 5:
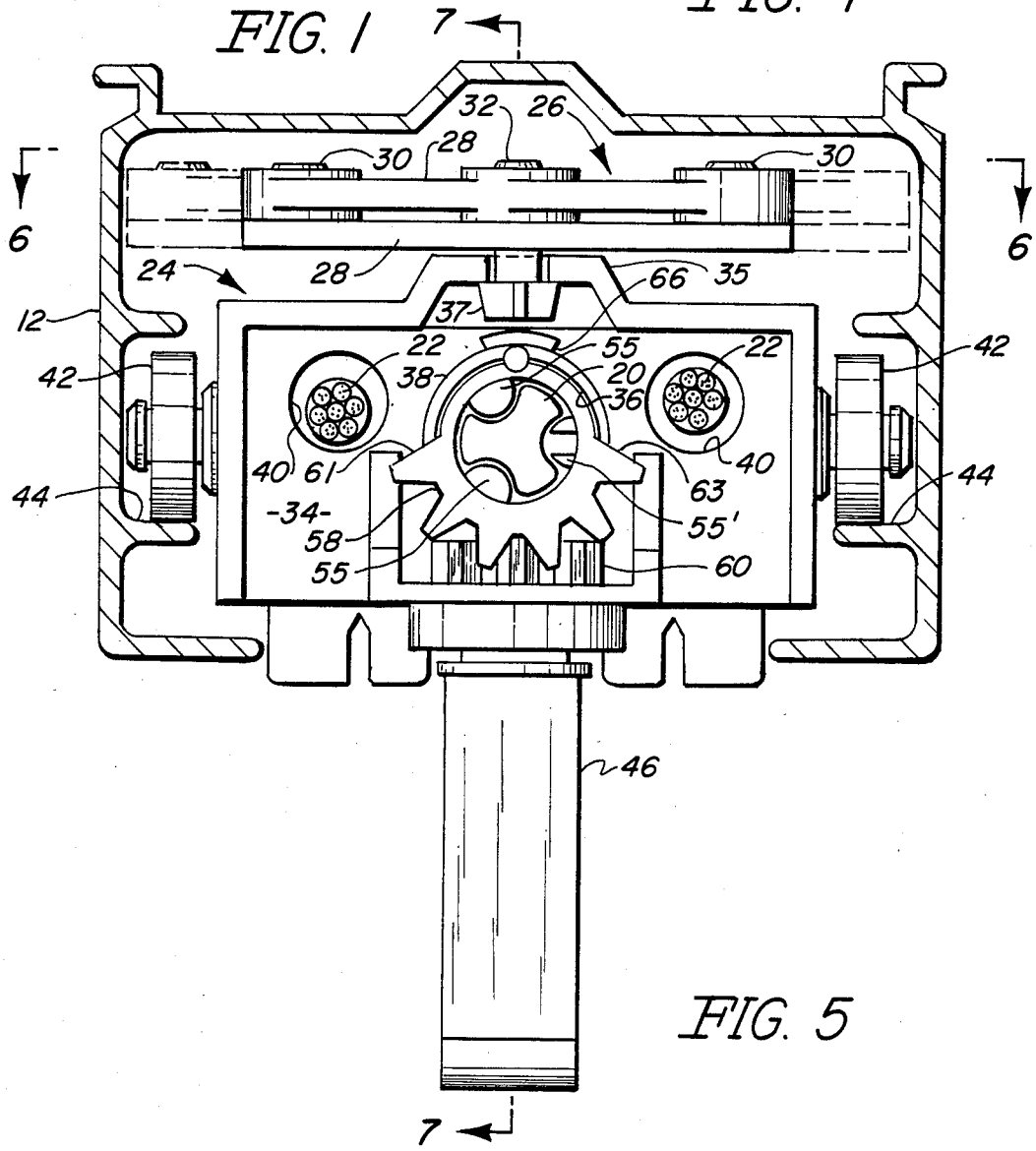
FIG. 5 is a sectional view along line 5—5 of FIG. 1 showing details of one carrier assembly of the present invention.
Figure 7:
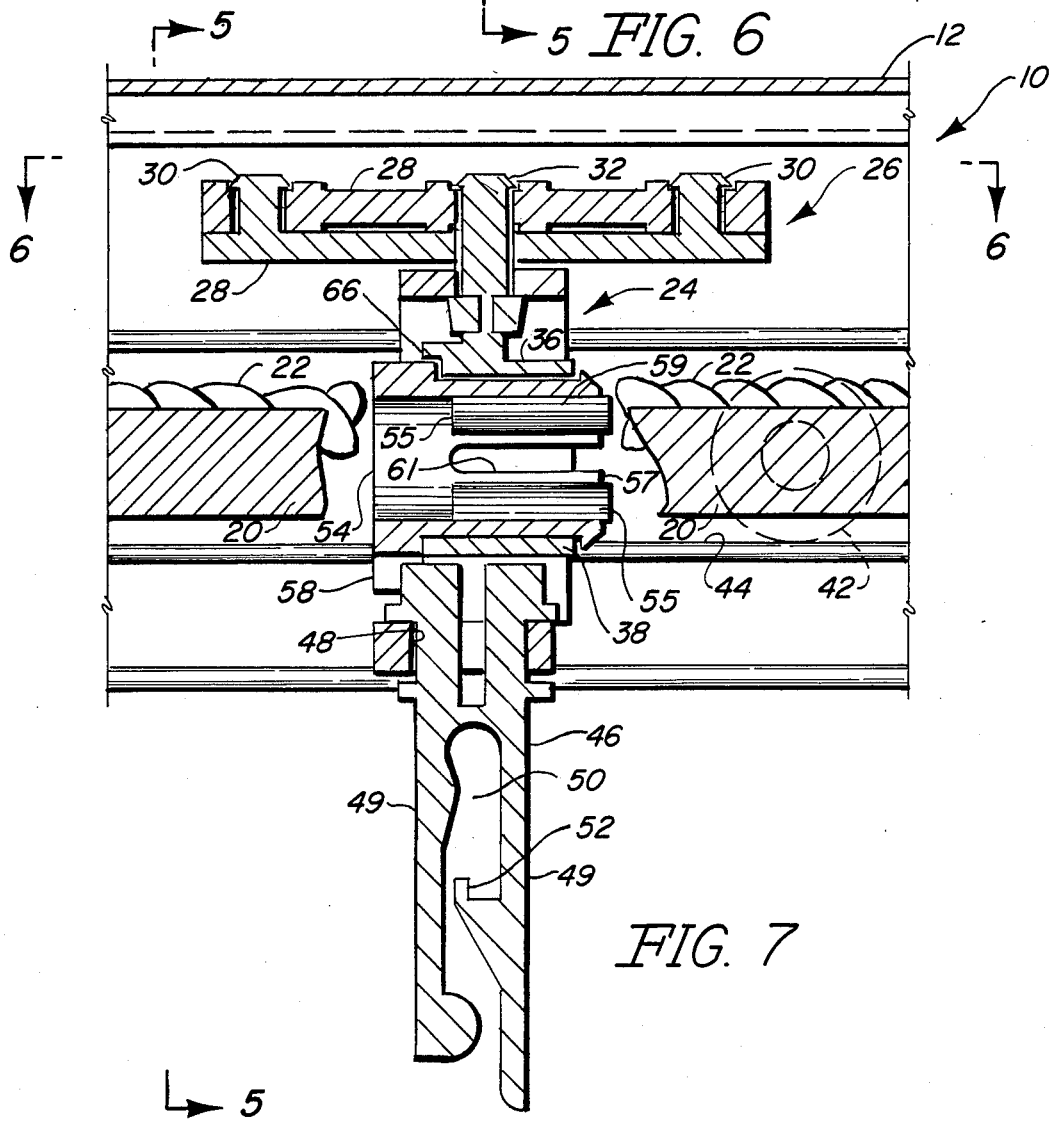
FIG. 7 is a transverse sectional view along line 7—7 of FIG. 5.

With regard primarily to FIGS. 5 and 7, an important feature of the present invention is the structure of the carrier assembly 24. More specifically, each of the carrier assemblies 24 are commonly structured, dimensioned and configured and include a base 34 having a substantially central aperture 36 defined by a tubular structure 38 having an angular configuration. Aperture 36 comprises one of a plurality of apertures including apertures 40. Apertures 40 are designed to receive the pull cords 22, as shown in FIG. 5.

Support members 42 are located externally of the base 34 at opposite ends thereof (see FIG. 5) and engage what may be considered a track assembly 44 integrally formed on and extending along the length of opposite longitudinal sides of the header structure 12. The support structures 42 may be in the form of rollers or slide elements, but are disposed and dimensioned to move along the length of the track structures 44 so as to allow moving support of the carrier assembly 24 as they in turn are displaced along the length of the supporting header structure 12.

Each of the carrier assemblies 24 further includes a carrier element 46 removably secured to the base 34 by fitting within a receiving channel 48. As is clearly shown in FIGS. 5 and 7, the carrier element effectively depends from each of the bases 34 and is oriented in a somewhat transverse or perpendicular relation to the drive rod 20 and the central aperture 36 in which it is located. Each of the carrier elements 46 includes spaced apart carrier fingers 47 and 49 formed of a flexible or substantially resilient plastic or like material to define a slot 50 and a locking member 52 protruding into the slot 50. The top end of each of the slats or blinds 14 is removably secured to the carrier element by placing it between the fingers 49 and within the slot 50 in supporting engagement with the locking member 52.

An important feature of the present invention is the provision of a drive element 54 in the form of a sleeve, rotatably mounted within the central aperture 36 and further disposed in surrounding, interlocking engagement with the drive rod 20. Three protruding nipples 55 are secured to the inner surface of the drive element 54 and extends into the interior thereof into engagement with separate ones of the elongated grooves integrally formed in the drive rod 20, as best shown in FIG. 5. It should further be noted that one of the nipples 55 as at 55' is slotted or segmented so that the portions thereof may be compressed towards one another so as to facilitate a firm fitting of the drive element sleeve 54 and the nipples 55 into firm surrounding engagement with the drive rod 20. Accordingly, rotation of the drive rod 20 about its own longitudinal axis will in turn cause rotation of the drive element 54 within the central aperture 36.

A first gear 58 is disposed in intermeshing and driving engagement with a second gear 60. The first gear 58 is integrally formed on one end of the drive element 54 and comprises a curvilinear, elongated segment gear, best shown in FIG. 5. The first gear 58 specifically does not extend about the entire periphery of the corresponding end of the drive element 54, but in fact, includes opposite free ends 61 and 63, which terminate in spaced relation to one another at a location which extends the curvilinear segment gear 58 less than half way about the periphery of the end of the drive element 54. However, the first gear 58 does extend radially outward from the central axis of the drive element and therefore extends into engaging relation with the circular second gear 60 affixed to the upper end of the carrier element 46 as shown in FIGS. 5 and 7. It should be readily apparent, therefore, that rotation of the drive rod 20 in turn causes rotation of the drive element 54 and displacement of the curvilinear segment gear 58. Movement of segment gear 58 in turn causes rotation of the gear 60 and the attendant accompanying rotation of the carrier element 46 and the attached vertically oriented blind or slat 14.

Another feature of the present invention comprises a stop means in the form of a fixed stop element 66 mounted on the base and extending outwardly from one face thereof into interruptive relation to the path of travel of the first gear 58 as the drive element 54 rotates with the drive rod 20. More specifically, opposite ends of the stop element 66 abut the opposite free ends 61 and 63 of the segment gear 58 based on the direction of rotation of the gear 58 relative to the stop element 66. It should be apparent that rotational displacement of the carrier element 46 and the individual blind or slat 14 attached thereto is limited by abutting engagement of one or both of the opposite ends 61 and 63 with the stop element 66.

In addition, structural features include the drive element 54 being formed of a plurality of segments 57 and 59 at substantially one end thereof. The segments are separated by a slot 61 extending through one end of the drive element 54 opposite to the disposition of the first gear 58. This segmented construction allows forced placement of the segments towards one another into a constricted orientation so as to fit the drive element 54 within the central aperture 36.

A somewhat similar segmented construction may be utilized in the formation of the central pivot pin or link 32 so as to allow passage thereof through the center receiving aperture of each of the links 28 and the crown 35 of the base 34. Further, an enlarged head 37 may be provided to retain the base 34, and more specifically, the crown 35 on the pin 32, and maintain its interconnection and support from the connecting links 28 of the connecting means 26.

Figure 8:
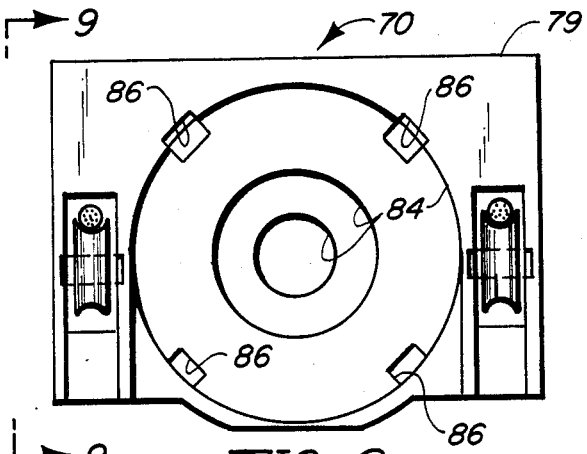
FIG. 8 is an exterior end view along line 8—8 of FIG. 9 of a first end cap defining, in part, a drive assembly of the present invention.
Figure 9:
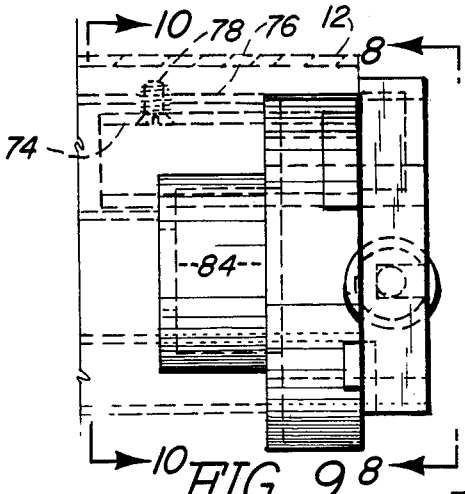
FIG. 9 is a side view along line 9—9 of FIG. 8.
Figure 10:
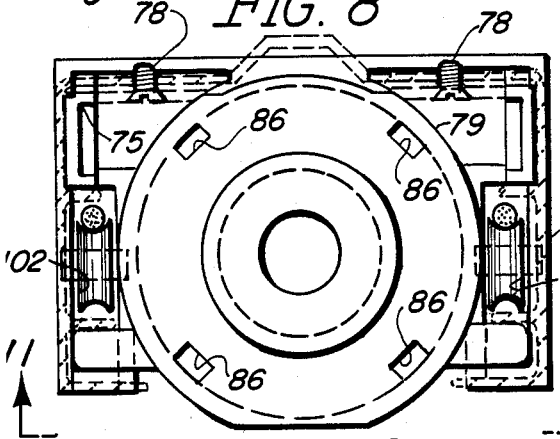
FIG. 10 is an interior end view and partial section along line 10—10 of FIG. 9.
Figure 11:
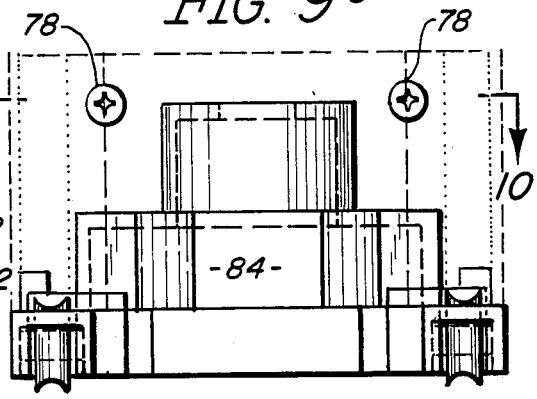
FIG. 11 is a bottom view in partial cut-away along line 11—11 of FIG. 10.
Figure 17:
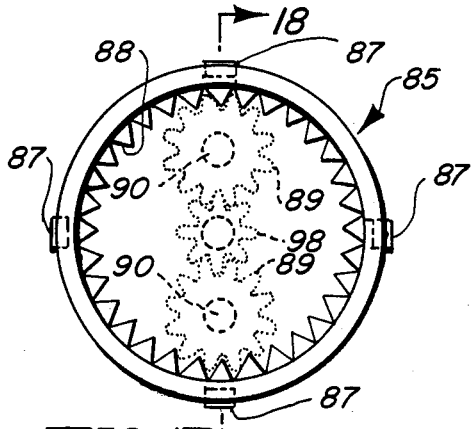
FIG. 17 are additional driving components associated with the rotation of the drive rod all of which are mounted on or in the first end cap structure of FIGS. 8 through 11 wherein cooperative gear elements are represented in phantom lines.
Figure 18:
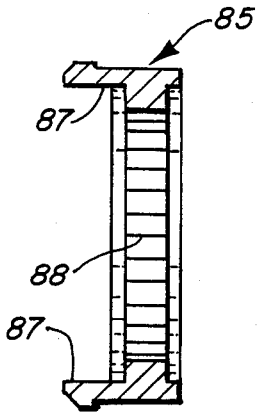
FIG. 18 is a sectional view along line 18—18 of FIG. 17.
Figure 19:
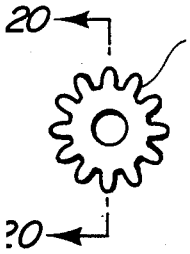
FIG. 19 is a detailed view of the drive gear associated with and mounted on one end of the drive rod of the present invention.
Figure 20:
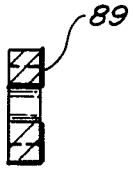
FIG. 20 is a sectional view along line 20—20 of FIG. 19.
Figure 21:
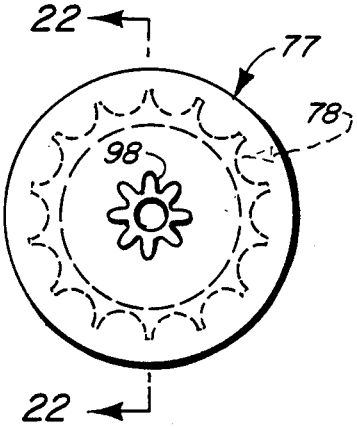
FIG. 21 is a pulley structure designed to cooperate with and be rotationally driven by a pull chain, more clearly shown in FIG. 27, wherein operation of the pull chain causes eventual rotation of the drive rod.
Figure 22:
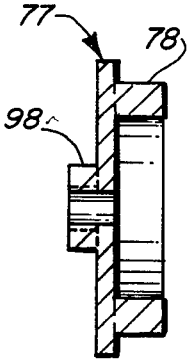
FIG. 22 is a sectional view along line 22—22 of FIG. 21.
Figure 23:
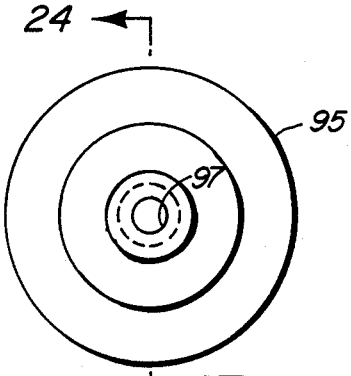
FIG. 23 is an exterior end view of an end plate.
Figure 24:
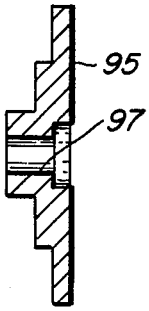
FIG. 24 is a sectional view along line 24—24 of FIG. 23.
Figure 25:
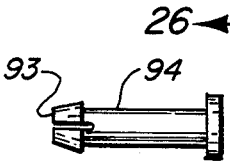
FIG. 25 is a detailed view of a connecting pin associated with the first end cap of FIGS. 8 through 11.
Figure 26:
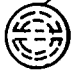
FIG. 26 is an end view along line 25—25.
Figure 27:
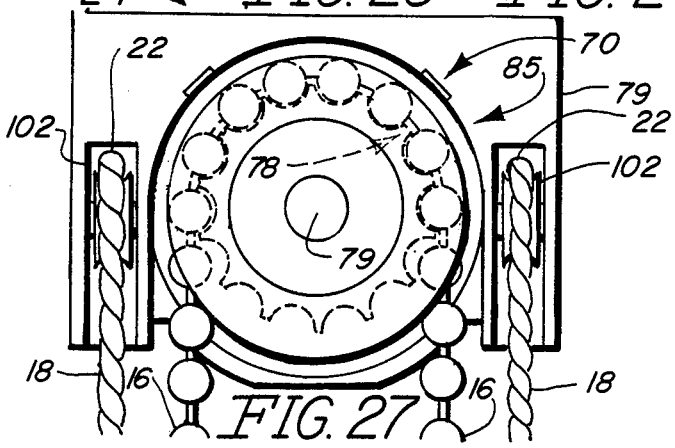
FIG. 27 is a partially assembled end view of the components of FIGS. 16 through 26 associated with the housing of the first end cap of FIGS. 8 through 11.

An important feature of the present invention is the aforementioned drive means or drive assembly associated with the controlled movement of the vertically oriented slats or blinds 14. Such movement, as also set forth above, is accomplished through the manipulation of the pull chain 16 and cord assembly 18 as they cooperate with two oppositely disposed end cap assemblies 70 and 72 secured to opposite ends of the header assembly 12 as generally represented in FIG. 1 and shown in greater detail in FIGS. 8 through 27. Fixed connection of each of the first and second end cap assemblies 70 and 72, respectively, occurs by virtue of an outwardly extending flange 74 and 75 secured to and extending outwardly from an upper portion of each of the respective cap assemblies 70 and 72. Respective flanges 74 and 75 are affixed to an upper interior surface portion of the header 12 as at 76 by set screws 78. End cap assembly 70 cooperates directly with the entrance of each of the pull chain 16 and pull cord 18 wherein the manipulation or pulling of the chain 16 causes a rotation of the drive rod 20 by the length of the pull chain 16 engaging the socketed continuous surface 78 (see FIGS. 21 and 27) causing a rotation thereof about a central axis 79. The axis 79 is coaxial with the central axis of the drive rod 20 and is interconnected thereto so as to cause its rotation. The end cap 70 includes an outer casing 79 surrounding a plurality of interacting components which, as set forth above, are specifically constructed and interconnected to facilitate the rotation of the drive rod 20. The opposite end cap assembly 72 engages the correspondingly positioned extremity of the drive rod 20 within a central socket 81. A stop member 83 is positioned within the socket to ensure that the correspondingly positioned end of the drive rod 20 as at 20' (see FIG. 14) does not pass therethrough. FIG. 8 represents an exterior end view of the casing showing a multi-step cavity 84 for the receipt of the various components to be described in greater detail hereinafter A plurality of apertures extend through the wall of the casing as at 86 and are disposed and configured to receive a plurality of outwardly extending fingers 87 formed on a retaining ring, the inside surface of which is a continuous ring gear as at 88. The fingers 87 have an extremity specifically designed to pass through the apertures 86 and grip the exterior portions thereof so as to provide a removable "snap-fit" connection. This readily facilitates the insertion and removal of the movable components of the end cap assembly 70 from one another thereby allowing its easy repair and replacement without disassembling the entire vertical blind assembly as is common in the prior art. The retaining ring 85 is disposed in surrounding and substantially encasing relation to a plurality of planetary gears 89 mounted on outwardly extending fingers or spindles 90 of a gear holder 92. The gear holder 90 is interconnected to the pulley member 77 which engages and is driven by the pulling of chain 16 as set forth above by means of an elongated interconnecting pin member 94 passing through an outer cover or cap 95 by means of a central aperture thereof 97. A central driving gear 98 is fixed or integrally formed on the exterior surface of the pulley 77, as shown in FIGS. 17 and 22, and serves to drivingly rotate the planetary gears 89. The rotation of the planetary gears mounted on spindles 90 of the gear-bearing member 92 causes a rotation of the gear-bearing member 92 and the retaining ring 85 is maintained in a fixed position due to its interconnection of the fingers 87 with the outer housing or casing 79 of the one end assembly 70. The extremity or end of the drive rod 20 fits within the sleeve or socket 100 and is thereby caused to rotate due to a driving interconnection with the appropriately positioned extremity and the interior of the socket 100. Other structural features of the housing include two receiving rollers 102 on opposite sides of the casing 79. The rollers 102 are freewheeling and positioned to receive the length of the pull cord 18 as it enters the header and, for purposes of clarity, is thereafter designated by the reference numeral 22 as its length extends along the length of the interior of the header in cooperative relation with each of the carrier assemblies 24. With reference to FIG. 5, it is seen that the length of the cord 22 passes through the previously described apertures 40 in each of the carrier assemblies.

Figure 12:
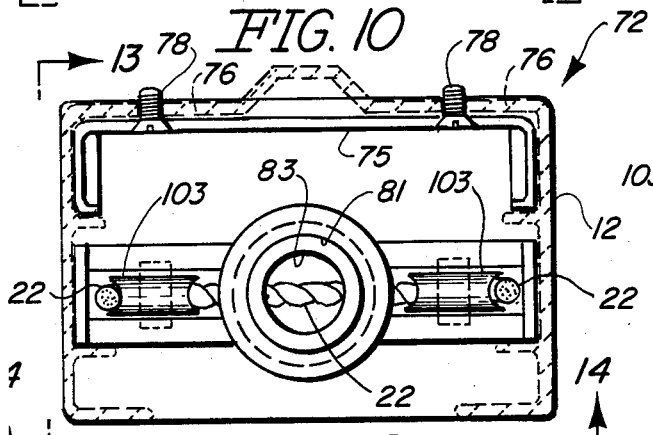
FIG. 12 is an exterior end view of a second end cap of the drive assembly of the present invention mounted on a header structure at the opposite end thereof relative to the first end cap as disclosed in FIGS. 8 through 11.
Figure 13:
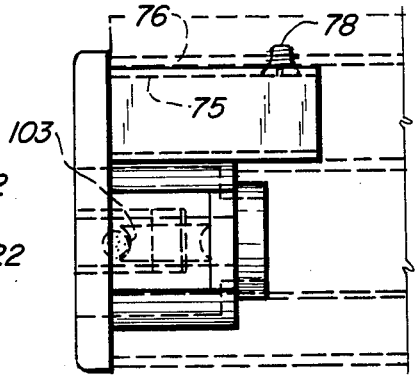
FIG. 13 is a side view in partial cut-away along line 13—13 of FIG. 12.
Figure 14:
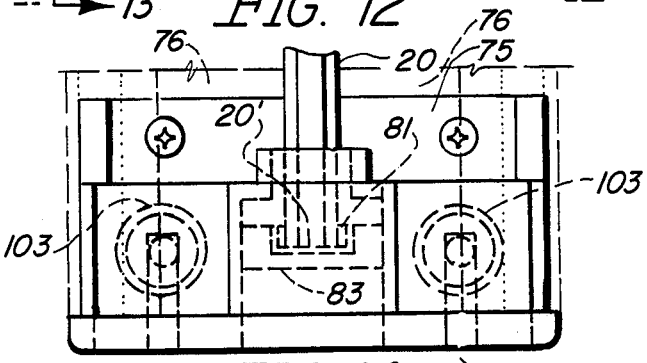
FIG. 14 is a bottom view along line 14—14 of FIG. 12.
Figure 15:
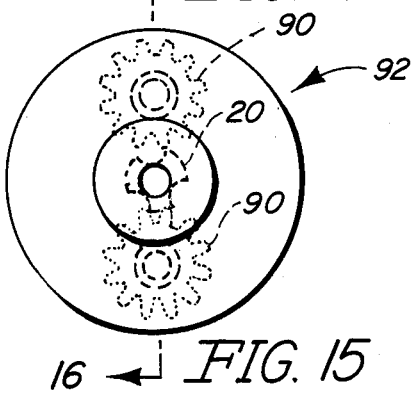
FIG. 15 is a detailed view of the interior of the first end cap structure of FIGS. 8 through 11.
Figure 16:
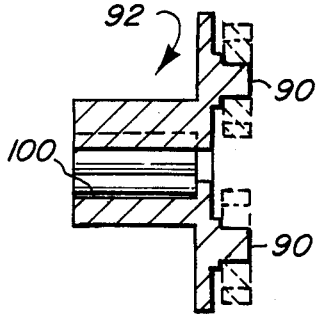
FIG. 16 is a sectional view along line 16—16 of FIG. 15 of internal components of the first end cap.

Further, with regard to FIGS. 12 through 14, the opposite or second end cap assembly 72 has additional rollers 103 oppositely oriented relative to rollers 102 to the extent that the axis of rotation of rollers 103 are in a substantially vertical orientation wherein the axis of rotation of rollers 102 are in a substantially horizontal orientation.

Now that the invention has been described,

What is claimed is:

1. A vertical blind assembly comprising a plurality of vertically oriented slats disposed in spaced apart relation to one another and independently rotated about their own longitudinal aixs and collectively positionable between an extended and a closed orientation relative to and along the length of a supporting header structure, an improvement comprising:

a. a plurality of carrier assemblies equal in number to the number of slats depending from said header structure and removably positionable along the length of said header structure, b. connecting means for interconnecting said plurality of carrier assemblies to one another and for collective movement thereof along said header structure, c. each carrier assembly comprising a base and a carrier element movably attached in depending relation to said base, said carrier element securable in supporting engagement with one of said slats, d. an aperture means formed in said base and including a substantially central aperture; a drive rod having an elongated configuration and disposed to extend through each of said central apertures of each base, e. each carrier assembly further comprising a drive element mounted on the respective base within said central aperture thereof and in surrounding, connected relation to said drive rod and rotatable therewith, f. said drive element comprising an elongated annular configuration and a plurality of spaced apart body segments extending to one end thereof and formed of flexible material and having at least one longitudinally extending slot extending from our end of said drive element thereby allowing said one end to be forced into a constricted position of lesser diameter than said central aperture, whereby said drive element may be removably fitted within said central aperture, g. a first gear structure fixedly mounted on said drive element and rotatable therewith, a second gear element fixedly mounted on said carrier element and rotatable therewith and connected in meshing engagement with said first gear structure, and h. said drive rod and said, drive element, first and second gear structures and carrier element of each carrier assembly all cooperatively disposed and structured to concurrently rotate said slats upon rotation of said driving rod.

2. An assembly as in claim 1 wherein said drive element comprises a substantially angular configuration rotatable about its own central axis and a central axis of said drive rod and with said drive rod, said carrier element disposed in transverse relation to said drive element.

3. An assembly as in claim 2 wherein said first gear structure is mounted on an outer end portion of said drive element and comprises a curvilinear configuration extending partially about a periphery of said end portion and having a length less than half of said periphery.

4. An assembly as in claim 3 wherein said first gear structure comprises a curvilinear segment gear.

5. An assembly as in claim 3 wherein said second gear is mounted on one end of said curvilinear element immediately adjacent said drive element and disposed in transverse intermeshing engagement with said first gear structure.

6. An assembly as in claim 5 wherein said first gear structure comprises a longitudinal dimension sufficient to engage and drivingly rotate said second gear through an arc of at least 180 degrees.

7. An assembly as in claim 1 wherein each of said carrier elements is removably connected to respective ones of said bases.

8. An assembly as in claim 1 wherein said first gear comprises a curvilinear segment gear mounted on an opposite end of said drive element and extending continuously about an outer periphery of said opposite end.

9. An assembly as in claim 1 wherein said drive element is removably and rotatably mounted within said central aperture of said base to which it is connected.

10. An assembly as in claim 3 further comprising stop means fixedly mounted on said base in interruptive relation to a path of travel of said first gear structure upon rotation of said driving element for stopping movement thereof, and restricting rotational displacement of said carrier element.

11. An assembly as in claim 10 wherein said first gear structure and said stop means are correspondingly disposed to define abutting engagement of each opposite free end of said first gear structure upon respective rotation thereof in opposite directions.

12. An assembly as in claim 11 wherein said stop means comprises a finger integrally secured to said base and projecting outwardly therefrom above and adjacent said central aperture and between said opposite free ends of said first gear for respective, interruptive engagement therewith.

13. An assembly as in claim 1 further comprising drive means for rotating said drive rod and being interconnected in driven relation to a pull chain and comprising a first end cap assembly and a second end cap assembly both mounted on the header structure and connected to an opposite end of said drive rod, said first end cap assembly drivingly engaging said drive rod and said second end cap assembly rotatably supporting said drive rod.

14. An assembly as in claim 13 wherein at least one of said first and second end cap assemblies comprise a mounting flange means extending outwardly from an upper portion thereof and being configured and disposed for attachment to an upper, inner surface of said header structure.

15. An assembly as in claim 13 wherein said first end cap assembly comprises a casing fixedly secured to one opposite end of said header structure and a plurality of movable components removably mounted on said casing in driving interconnection to said drive rod, said plurality of movable components removable from said casing without detachment of said casing from said header structure.

16. An assembly as in claim 15 wherein said plurality of movable components comprise a pulley engaging said pull chain and rotatably driven thereby, a drive gear secured to said pulley and rotatable therewith, a gear support member secured to a correspondingly positioned end of said drive rod in driving engagement therewith, and drive gear means mounted on said gear support member and rotatable therewith and further rotatably interconnecting said main drive gear to said gear support member whereby movement of said pull chain along its length causes rotation of said pulley and said drive rod through cooperative engagement of said movable components.

17. An assembly as in claim 16 further comprising a retaining member removably connected to said casing and disposed in surrounding relation to said drive gear, said gearing means and said gear support member.

18. An assembly as in claim 17 wherein said retaining member comprises a plurality of outwardly extending fingers each being flexible and removably extendable within one of a plurality of spaced apart apertures formed in said casing, engagement of said plurality of fingers within said plurality of apertures causes retention of said movable components on said casing.

19. A vertical blind assembly comprising a plurality of vertically oriented slats disposed in spaced apart relation to one another and independently rotated about their own longitudinal axis and collectively positionable between an extended and a closed orientation relative to and along the length of a supporting header structure, an improvement comprising:

a. a plurality of carrier assemblies equal in number to the number of slats depending from said header structure and removably positionable along the length of said header structure, b. connecting means for interconnecting said plurality of carrier assemblies to one another and for collective movement thereof along said header structure, c. each carrier assembly comprising relation to said base, a said carrier element securable in supporting engagement with one of said slats, d. an aperture means formed in said base and including a substantially central aperture; a drive rod having an elongated configuration and disposed to extend through each of said central apertures of each base, e. each carrier assembly further comprising a drive element mounted on the respective base within said central aperture thereof and in surrounding, connected relation to said drive rod and rotatable therewith, f. a first gear structure fixedly mounted on said drive element and rotatable therewith, a second gear element fixedly mounted on said carrier element and rotatable therewith and connected in meshing engagement with said first gear structure, g. said drive rod and said, drive element, first an second gear structures and carrier element of each carrier assembly all cooperatively disposed and structured to concurrently rotate said slats upon rotation of said driving rod, h. a drive means for rotating said drive rod and being interconnected in driven relation to a pull chain and comprising a first end cap assembly and a second end cap assembly both mounted on the header structure and connected to an opposite end of said drive rod, said first end cap assembly drivingly engaging said drive rod and said second end cap assembly rotatably supporting said drive rod, i. at least one of said first and second end cap assemblies comprising a mounting flange means extending outwardly form an upper portion thereof and being configured and disposed for attachment to an upper, inner surface of said header structure, j. said first end cap assembly comprising a casing fixedly secured to one opposite end of said header structure and a plurality of movable components removably mounted on said casing in driving interconnection to said drive rod, said plurality of movable components removable from said casing without detachment of said casing from said header structure.

k. said plurality of movable components comprising a pulley engaging said pull chain and rotatably driven thereby, a drive gear secured to said pulley and rotatable therewith, a gear support member secured to a correspondingly positioned end of said drive rod in driving engagement therewith, and drive gear means mounted on said gear support member and rotatable therewith and further rotatably interconnecting said main drive gear to said gear support member whereby movement of said pull chain along its length causes rotation of said pulley and said drive rod through cooperative engagement of said movable components, l. a retaining member removably connected to said casing and disposed in surround relation to said drive gear, said gearing means and said gear support member, and m. a connecting pin removably attached to and extending coaxially through each of said movable components and removable therewith from said casing.

* * * * *